US010871330B2

(12) United States Patent
Romlund

(10) Patent No.: US 10,871,330 B2
(45) Date of Patent: Dec. 22, 2020

(54) PLATE HEAT EXCHANGER

(71) Applicant: ALFA LAVAL CORPORATE AB, Lund (SE)

(72) Inventor: Jens Romlund, Helsingborg (SE)

(73) Assignee: ALFA LAVAL CORPORATE AB, Lund (SE)

( * ) Notice: Subject to any disclaimer, the term of this patent is extended or adjusted under 35 U.S.C. 154(b) by 79 days.

(21) Appl. No.: 16/463,252

(22) PCT Filed: Dec. 1, 2017

(86) PCT No.: PCT/EP2017/081167
§ 371 (c)(1),
(2) Date: May 22, 2019

(87) PCT Pub. No.: WO2018/114288
PCT Pub. Date: Jun. 28, 2018

(65) Prior Publication Data

US 2019/0264985 A1 Aug. 29, 2019

(30) Foreign Application Priority Data

Dec. 22, 2016 (SE) ..... 1651728

(51) Int. Cl.
*F28D 9/00* (2006.01)

(52) U.S. Cl.
CPC ..... *F28D 9/0093* (2013.01); *F28D 9/005* (2013.01)

(58) Field of Classification Search
CPC ..... F28D 9/0093; F28D 9/005; F28D 7/0066; F28D 2021/0089; F28F 3/086; F28F 3/046; F28F 3/02; Y10S 165/371
(Continued)

(56) References Cited

U.S. PATENT DOCUMENTS 5,462,113 A 10/1995 Wand
6,142,221 A * 11/2000 Johansson ..... F28D 9/0093 165/140

(Continued)

FOREIGN PATENT DOCUMENTS

CN 1151207 A 6/1997
CN 1248320 A 3/2000

(Continued)

OTHER PUBLICATIONS

International Search Report, issued in PCT/EP2017/081167, dated Feb. 21, 2018.

(Continued)

*Primary Examiner* — Tho V Duong
(74) *Attorney, Agent, or Firm* — Birch, Stewart, Kolasch & Birch, LLP

(57) ABSTRACT

A plate heat exchanger includes heat exchanger plates forming first, second and third plate interspaces. The plates extend between a top plane and a bottom plane. First inlet and outlet ports communicate with the first plate interspaces. Second inlet and outlet ports communicate with the second plate interspaces. Third inlet and outlet ports communicate with the third plate interspaces. A porthole of the second and third ports is surrounded by an outer flat area surrounded by an inner flat area. The outer flat area is located at one of the top and bottom planes. The inner flat areas of the second ports of the plates, enclosing the second plate interspaces, are located at a distance from each other. The inner flat areas of the second ports of the plates, enclosing the third plate interspaces, adjoin each other.

20 Claims, 4 Drawing Sheets

(58) Field of Classification Search
USPC ..... 165/140
See application file for complete search history.

(56) References Cited

U.S. PATENT DOCUMENTS

| | | | | |
|---|---|---|---|---|
| 6,164,371 | A | 12/2000 | Bertilsson et al. | |
| 6,305,466 | B1 | 10/2001 | Andersson et al. | |
| 7,775,264 | B2 | 8/2010 | Andersson et al. | |
| 2010/0032148 | A1 | 2/2010 | Bermhult | |
| 2011/0083833 | A1* | 4/2011 | Zorzin | F28D 9/0093 165/166 |

FOREIGN PATENT DOCUMENTS

| | | | | |
|---|---|---|---|---|
| CN | 1892162 | A | 1/2007 | |
| CN | 1902456 | A | 1/2007 | |
| CN | 102187171 | B | 8/2013 | |
| EP | 1 850 082 | A1 | 10/2007 | |
| EP | 2 080 976 | A1 | 7/2009 | |
| JP | 2000-266479 | A | 9/2000 | |
| KR | 10-2009-0069326 | A | 8/2009 | |
| SE | 531 048 | C2 | 12/2008 | |
| WO | WO 97/08506 | A1 | 3/1997 | |
| WO | WO 98/37373 | A1 | 8/1998 | |
| WO | WO-9946550 | A1 * | 9/1999 | F28D 9/0093 |
| WO | WO 2005/066572 | A1 | 7/2005 | |
| WO | WO 2008/063121 | A1 | 5/2008 | |
| WO | WO 2010/039086 | A1 | 4/2010 | |

OTHER PUBLICATIONS

Written Opinion of the International Searching Authority, issued in PCT/EP2017/081167, dated Feb. 21, 2018.
English Translation of the Korean Office Action dated Aug. 21, 2020, for Korean Application No. 10-2019-7020814.

* cited by examiner

PLATE HEAT EXCHANGER

TECHNICAL FIELD OF THE INVENTION

The present invention refers to a plate heat exchanger according to the preamble of claim 1. Such a plate heat exchanger is disclosed in U.S. Pat. No. 6,164,371.

BACKGROUND OF THE INVENTION AND PRIOR ART

Such prior art plate heat exchangers for three media may have six ports, wherein four of the ports will be open to one plate interspace, closed to the following two plate interspaces, open to the following one plate interspace, closed to the following two plate interspace and so forth. The plate heat exchanger disclosed in U.S. Pat. No. 6,164,371 is disadvantageous due to weakness around these four ports and therefore susceptible to collapsing. Every third plate interspace is closed at these four ports by means of portholes with a smaller diameter than the adjacent portholes. The outer flat area of the portholes with smaller diameter extends a longer distance into the port. In addition to reducing the free flow area of the ports, this solution results in a weakening of the heat exchanger plates in the area of these four portholes.

SUMMARY OF THE INVENTION

The object of the present invention is to overcome the problems discussed above and to provide an improved plate heat exchanger having plate interspaces for three different media.

This object is achieved by the plate heat exchanger initially defined, which is characterized in that the inner flat areas of the portholes of the second inlet and outlet ports of the heat exchanger plates, that enclose the second plate interspaces, are located at a distance from each other, and that the inner flat areas of the portholes of the second inlet and outlet ports of the heat exchanger plates, that enclose the third plate interspaces, adjoin each other and are located at one of the top plane and the bottom plane.

Thanks to the feature that the outer flat area of the portholes of all ports of all heat exchanger plates is located at one of the top plane and the bottom plane, the outer flat area of all heat exchanger plates will adjoin another outer flat area of an adjacent heat exchanger plate in the plate package. This structure ensures a high strength at the ports of the plate heat exchanger.

Thanks to the feature that the inner flat areas of the portholes of the second inlet and outlet ports of the heat exchanger plates, that enclose the second plate interspaces, are located at a distance from each other and from the top and bottom planes (6,7), for instance between the bottom plane and the top plane, the second inlet and outlet ports may communicate with the second plate interspaces.

Thanks to the feature that the inner flat areas of the portholes of the second inlet and outlet ports of the heat exchanger plates that enclose the third plate interspaces adjoin each other and are located at one of the top plane and the bottom plane, the inner flat areas of the portholes of the second inlet and outlet ports of the heat exchanger plates that enclose the third plate interspaces will adjoin each other for all heat exchanger plates enclosing the third plate interspaces.

According to an embodiment of the invention, the inner flat areas of the portholes of the third inlet and outlet ports of the heat exchanger plates, that enclose the third plate interspaces, are located at a distance from each other and from the top and bottom planes (6,7), for instance between the bottom plane and the top plane, wherein the inner flat areas of the portholes of the third inlet and outlet ports of the heat exchanger plates, that enclose the second plate interspaces, adjoin each other and are located at one of the top plane and the bottom plane. Consequently, the third inlet and outlet ports of the plates enclosing the third plate interspaces may be configured in the same way as the second inlet and outlet portion of the heat exchanger plates enclosing the third plate interspaces.

According to a further embodiment of the invention, the outer flat area of the portholes of the first inlet and outlet ports of the heat exchanger plates adjoins the corrugation of the heat exchanger area. Thus, there is no inner flat area surrounding the outer flat area of the portholes of the first inlet and outlet ports.

According to a further embodiment of the invention, each of the portholes of the second inlet port has a diameter that is equal for all heat exchanger plates of the plate package.

According to a further embodiment of the invention, each of the portholes of the second outlet port has a diameter that is equal for all heat exchanger plates of the plate package.

According to a further embodiment of the invention, each of the portholes of the third inlet port has a diameter that is equal for all heat exchanger plates of the plate package.

According to a further embodiment of the invention, each of the portholes of the third outlet port has a diameter that is equal for all heat exchanger plates of the plate package.

According to a further embodiment of the invention, the diameter of the portholes of the second inlet port is equal to the diameter of the portholes of the third inlet port.

According to a further embodiment of the invention, the diameter of the portholes of the second outlet port is equal to the diameter of the portholes of third outlet ports.

According to a further embodiment of the invention, the heat exchanger plates comprises first heat exchanger plates and second heat exchanger plates provided in an alternating order in the plate package.

According to a further embodiment of the invention, each of the second plate interspaces is provided between one of the second heat exchanger plates and one of the first heat exchanger plates, and each of the third plate interspaces is provided between one of the second heat exchanger plates and one of the first heat exchanger plates.

According to a further embodiment of the invention, the inner flat areas of the portholes of the second inlet and outlet ports of the first heat exchanger plates, that adjoin the third plate interspaces, is located at the bottom plane.

According to a further embodiment of the invention, the inner flat areas of the portholes of the second inlet and outlet ports of the second heat exchanger plates, that adjoin the third plate interspaces, is located at the top plane.

According to a further embodiment of the invention, the inner flat areas of the portholes of the third inlet and outlet ports of the first heat exchanger plates, that adjoin the second plate interspaces, is located at the top plane.

According to a further embodiment of the invention, the inner flat areas of the portholes of the third inlet and outlet ports of the second heat exchanger plates, that adjoin the second plate interspaces, is located at the bottom plane.

According to a further embodiment of the invention, each of the first plate interspaces is provided between one of the first heat exchanger plates and one of the second heat exchanger plates.

According to a further embodiment of the invention, the first heat exchanger plates comprise a first end plate that adjoins an outermost one of the first plate interspaces, and the second heat exchanger plates comprise a second end plate that adjoins another outermost one of the first plate interspaces.

According to a further embodiment of the invention, the inner flat area of the portholes of the second inlet and outlet ports and the third inlet and outlet ports of the first end plate is located at the top plane. The inner flat areas of the first end plate may thus adjoin a frame plate of the plate heat exchanger.

According to a further embodiment of the invention, the inner flat area of the portholes of the second inlet and outlet ports and of the third inlet and outlet ports of the second end plate is located at the bottom plane. The inner flat areas of the second end plate may thus adjoin a pressure plate of the plate heat exchanger.

BRIEF DESCRIPTION OF THE DRAWING

The present invention is now be explained more closely through a description of various embodiments and with reference to the drawings attached hereto.

DETAILED DESCRIPTION OF VARIOUS EMBODIMENTS

FIGS. 1 to 4 disclose a plate heat exchanger comprising a plate package of heat exchanger plates A, A', A", B, B', B". The heat exchanger plates A, A', A", B, B', B" are stacked onto each other to form first plate interspaces 1 for a primary medium, second plate interspaces 2 for a first secondary medium and third plate interspaces 3 for a second secondary medium.

The primary medium may be a heating or cooling medium, for instance hot or cold water. The first secondary medium may be a first refrigerant to be evaporated or condensed. The second secondary medium may be a second refrigerant to be evaporated or condensed.

Figure 3:
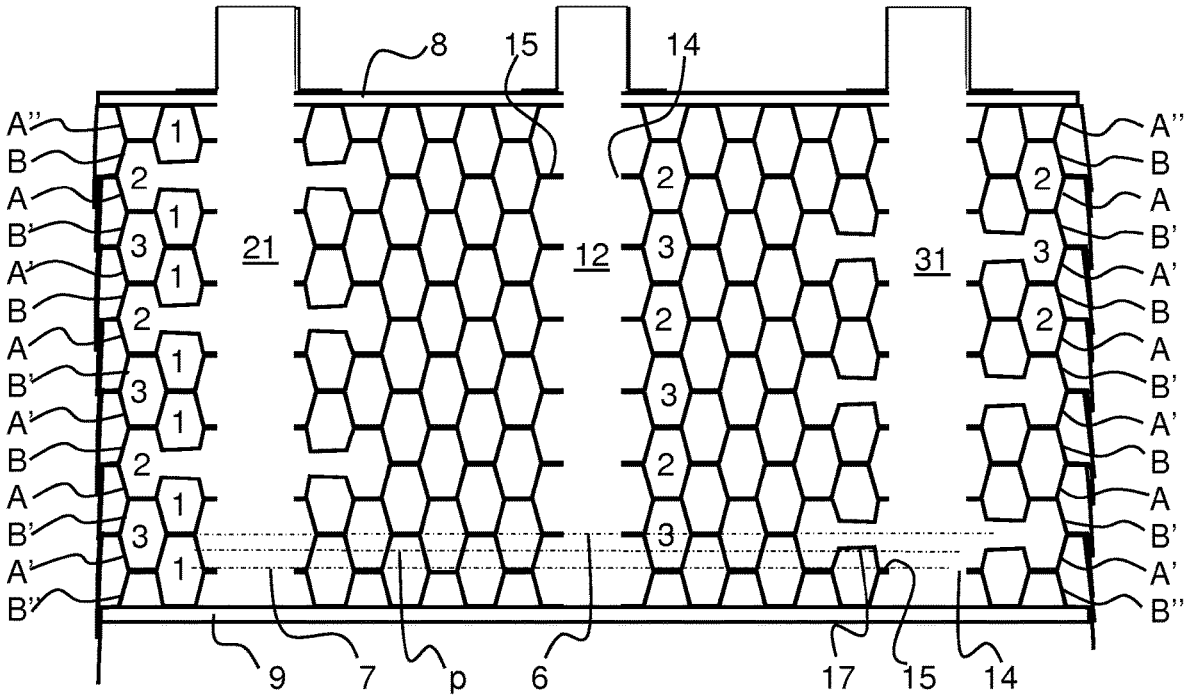
FIG. 3 discloses a sectional view along the line III-III in FIG. 1.
Figure 4:
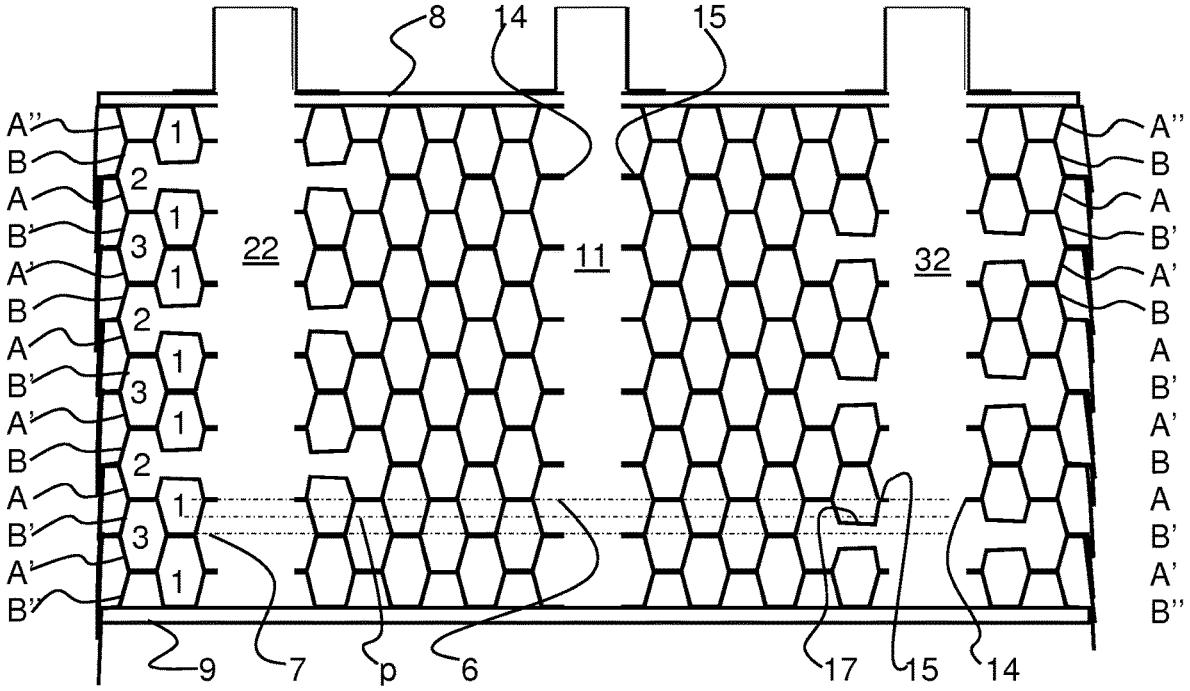
FIG. 4 discloses a sectional view along the line IV-IV in FIG. 1.

As can be seen in FIGS. 3 and 4, the plate interspaces 1-3 are arranged in the following order: a first plate interspace 1, a second plate interspace 2, a first plate interspace 1, a third plate interspace 3, a first plate interspace 1, a second plate interspace 2, a first plate interspace 1, a third plate interspace 3, a first plate interspace 1, a second plate interspace 2, a first plate interspace 1, a third plate interspace 3 and a first plate interspace 1. In the embodiments disclosed, the plate heat exchanger comprises 13 plate interspaces 1-3. This is only an example, and it should be noted that the plate heat exchanger may comprise a smaller or larger number of plate interspaces 1-3.

Figure 5:
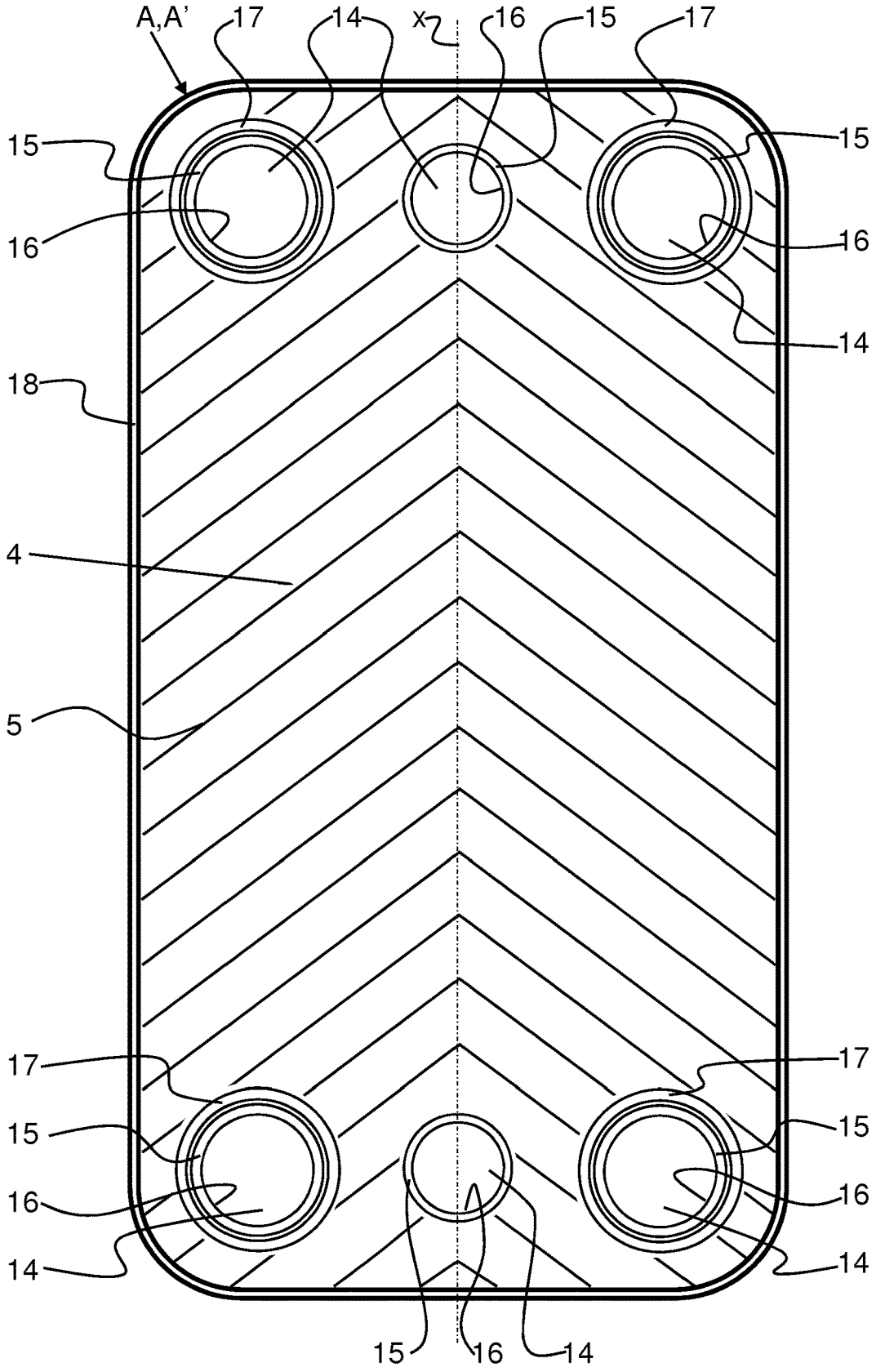
FIG. 5 discloses a first heat exchanger plate of the plate heat exchanger in FIG. 1.
Figure 6:
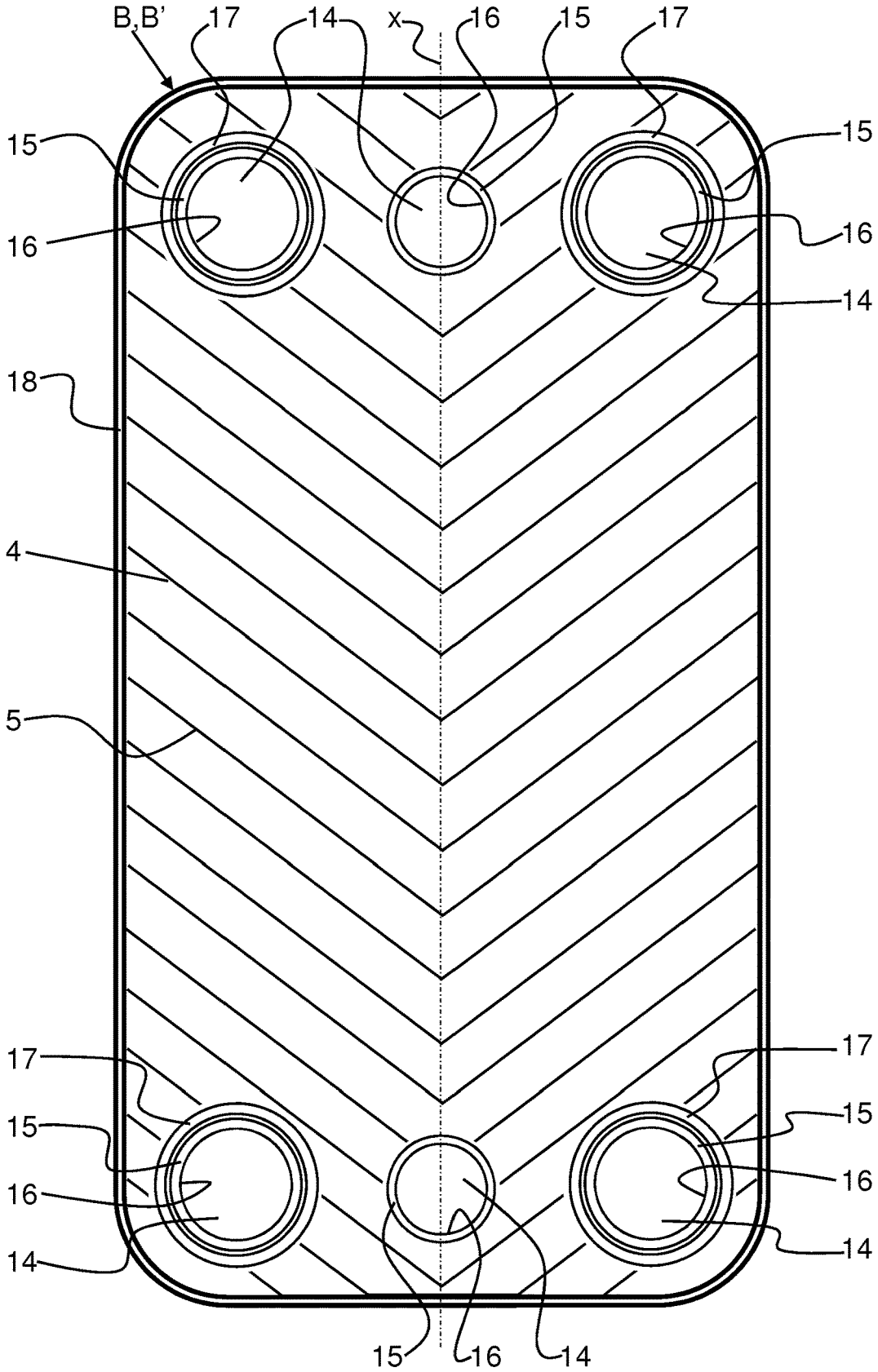
FIG. 6 discloses a second heat exchanger plate of the plate heat exchanger in FIG. 1.

Each heat exchanger plate A, A', A", B, B', B" extends in parallel with an extension plane p and comprises a heat exchanger area 4 with a corrugation 5, see FIGS. 5 and 6. The corrugation 5 extends between a top plane 6 and a bottom plane 7, see FIGS. 3 and 4. The top plane 6 and the bottom plane 7 are parallel to each other and to the extension plane p. The extension plane p forms a central plane extending in the middle between the top plane 6 and the bottom plane 7.

The corrugation 5 is formed by ridges and valleys. In the embodiments disclosed, the corrugation 5 of ridges and valleys extends to a longitudinal center axis x and forms an angle of inclination with the longitudinal center axis x. The corrugation 5 forms an arrow pattern, as can be seen in FIGS. 5 and 6. Other kinds of corrugations 5 are possible.

The plate heat exchanger and the plate package also comprises a frame plate 8 on one side of the heat exchanger plates A, A', A", B, B', B" and a pressure plate 9 on the other side of the heat exchanger plates A, A', A", B, B', B". As can be seen in FIGS. 3 and 4 also the frame plate 8 and the pressure plate 9 extend in parallel with the extension planes p of the heat exchanger plates A, A', A", B, B', B".

Figure 1:
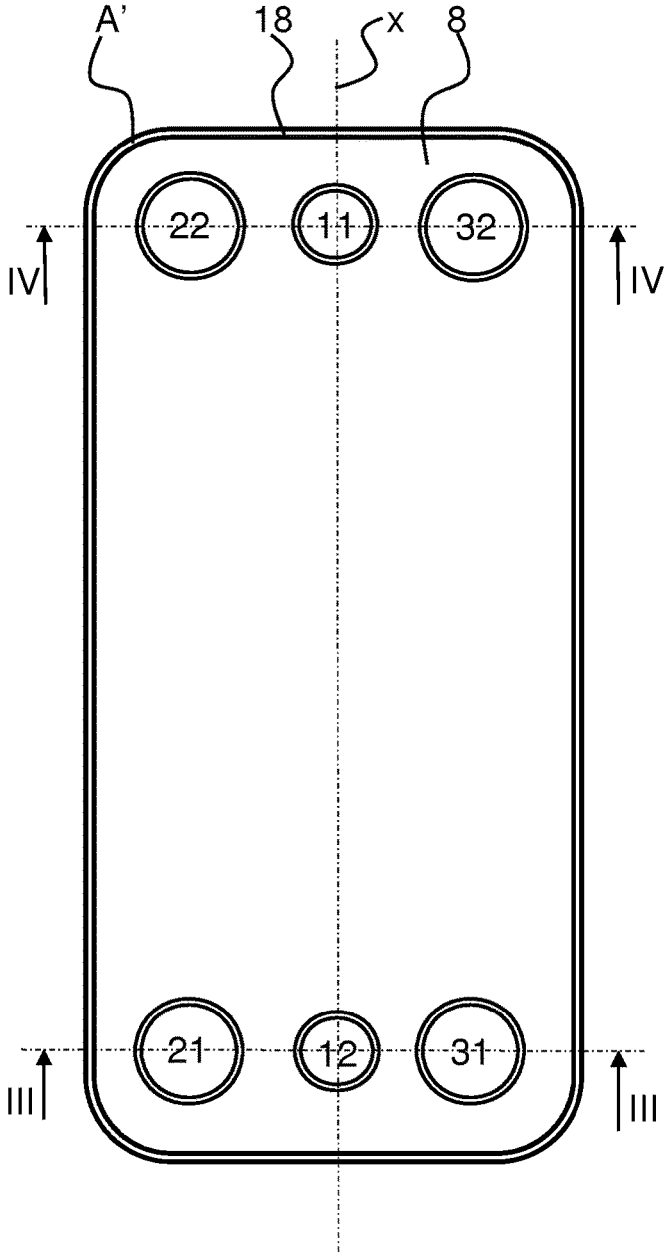
FIG. 1 discloses a front view of a plate heat exchanger according to an embodiment of the invention.
Figure 2:
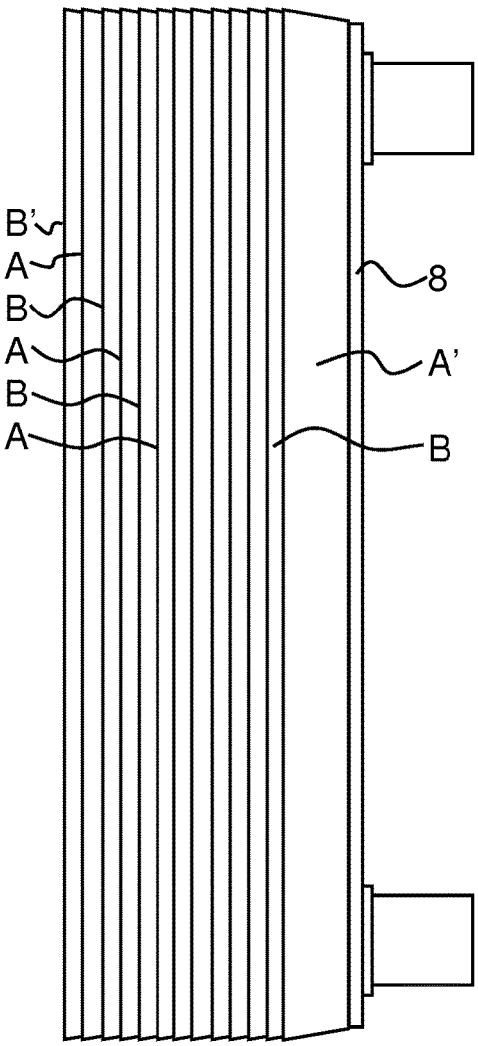
FIG. 2 discloses a side view of the plate heat exchanger in FIG. 1.

The plate heat exchanger and the plate package comprises six ports 11, 12, 21, 22, 31, 32 as can be seen in FIG. 1. The ports 11, 12, 21, 22, 31, 32 extend through the heat exchanger plates A, A', A", B, B', B" and through the frame plate 8.

The ports 11, 12, 21, 22, 31 and 32 comprise first inlet and outlet ports 11, 12, second inlet and outlet ports 21, 22 and third inlet and outlet ports 31, 32.

The first inlet port 11 and the first outlet port 12 communicate with the first plate interspaces 1, and permit the supply and discharge of the primary medium to and from the first plate interspaces 1. The first inlet and outlet ports 11, 12 are closed to the second and third plate interspaces 2, 3.

The second inlet port 21 and the second outlet port 22 communicate with the second plate interspaces 2, and permit the supply and discharge of the first secondary medium to and from the second plate interspaces 2. The second inlet and outlet ports 21, 22 are closed to the first and third plate interspaces 1, 3.

The third inlet port 31 and the third outlet port 32 communicate with the third plate interspaces 3, and permit the supply and discharge of the second secondary medium to and from the third plate interspaces 3. The third inlet and outlet ports 31, 32 are closed to the first and second plate interspaces 1, 2.

In the embodiments disclosed, the second inlet and outlet 21, 22 are located to the left in FIG. 1, and the third inlet and outlet 31, 32 to the right in FIG. 1. However, the flow of the first secondary and second secondary media may alternatively extend diagonally, so that the second inlet 21 and the third outlet 32 are located to the left and the second outlet 22 and third inlet 31 to the right in FIG. 1.

Each of the ports 11, 12, 21, 22, 31 and 32 is formed by a porthole 14 through each of the heat exchanger plates A, A', A", B, B', B", see FIGS. 5 and 6. Each porthole 14 is surrounded by an outer flat area 15. The outer flat area 15 forms or defines a porthole edge 16 of the porthole 14. The outer flat area 15 is annular and extends in parallel with the extension plane p.

The outer flat area 15 of portholes 14 the second inlet and outlet ports 21, 22 and of the third inlet and outlet ports 31, 32 is surrounded by an inner flat area 17, see FIGS. 5 and 6. The inner flat area 17 is annular and extends in parallel with the extension plane p.

The outer flat area 15 of the portholes 14 of the first inlet and outlet ports 11, 12 adjoins the corrugation 5 of the heat exchanger area 4, see FIGS. 5 and 6. Thus, there is no annular inner flat area around the outer flat area 15 of the portholes 14 of the first inlet and outlet ports 11, 12.

Each of the heat exchanger plates A, A', A", B, B', B" comprises an edge flange 18 that extends around the heat exchanger area 4. The edge flange 18 forms an angle of inclination to the extension plane p.

The heat exchanger plates A, A', A", B, B', B" comprise first heat exchanger plates A, A', A", see FIG. 5, and second heat exchanger plates B, B', B", see FIG. 6. The first and second heat exchanger plates A, A', A", B, B', B" are provided in an alternating order in the plate package.

The corrugation 5 of ridges and valleys forms an arrow along a first direction on the first heat exchanger plates A, A', A" and along a second direction on the second heat exchanger plates B, B', B", which is opposite to the first direction, as can be seen in FIGS. 5 and 6.

In the plate package, the edge flanges 18 of the first and second heat exchanger plates A, A', A", B, B', B" extend in the same direction. Possibly, the edge flange 18 of the first heat exchanger plates A, A', A" may extend from the top plane 6, and the edge flange 18 of the second heat exchanger plates B, B', B" may extend from the bottom plane 7.

Each of the first plate interspaces 1 is provided between one of the first heat exchanger plates A, A', A" and one of the second heat exchanger plates B, B', B" seen from the frame plate 8, or from an open end of the ports 11, 12, 21, 22, 31, 32. Each of the second plate interspaces 2 is provided between one of the second heat exchanger plates B, B', B" and one of the first heat exchanger plates A, A', A" seen from the frame plate 8, or from an open end of the ports 11, 12, 21, 22, 31, 32. Each of the third plate interspaces 3 is provided between one of the second heat exchanger plates B, B', B" and one of the first heat exchanger plates A, A', A", seen from the frame plate 8, or from an open end of the ports 11, 12, 21, 22, 31, 32.

Each of the portholes 14 of the second inlet port 21 has a diameter d that is equal for all heat exchanger plates A, A', A", B, B', B" of the plate package. Each of the portholes 14 of the third inlet port 31 has a diameter d that is equal for all heat exchanger plates A, A', A", B, B', B" of the plate package. The diameter of the portholes 14 of the second inlet port 21 may be equal to the diameter of the portholes 14 of the third inlet port 31.

Each of the portholes 14 of the second outlet port 22 has a diameter d that is equal for all heat exchanger plates A, A', A", B, B', B" of the plate package. Each of the portholes 14 of the third outlet port 32 has a diameter d that is equal for all heat exchanger plates A, A', A", B, B', B" of the plate package. The diameter of the portholes 14 of the second outlet port 22 may be equal to the diameter d of the portholes 14 of the third outlet port 32.

The outer flat area 15 of the portholes of the ports 11, 12, 21, 22, 31, 32 of the heat exchanger plates A, A', A", B, B', B" is located at and is parallel with one of the top plane 6 and the bottom plane 7.

More specifically, the outer flat area 15 of the portholes 14 of the second inlet port 21, the second outlet port 22, the third inlet port 31 and the third outlet port 32 of the first heat exchanger plates A, A', A" is located at the bottom plane 7. The outer flat area 15 of the portholes 14 of the first inlet port 11 and the first outlet port 12 of the first heat exchanger plates A, A', A" is located at the top plane 6.

In a corresponding manner, the outer flat area 15 of the portholes 14 of the second inlet port 21, the second outlet port 22, the third inlet port 31 and the third outlet port 32 of the second heat exchanger plates B, B', B" is located at the top plane 6. The outer flat area 15 of the portholes 14 of the first inlet port 11 and the first outlet port 12 of the second heat exchanger plates B, B', B" is located at the bottom plane 7.

The inner flat areas 17 of the portholes 14 of the second inlet and outlet ports 21, 22 of the heat exchanger plates B, A, that enclose a respective second plate interspace 2, are located at a distance from each other, and in the embodiments disclosed between the bottom plane 7 and the top plane 6.

The inner flat areas 17 of the portholes 14 of the third inlet and outlet ports 31, 32 of the heat exchanger plates B', A', that enclose a respective third plate interspace 3, are located at a distance from each other, and in the embodiments disclosed between the bottom plane 7 and the top plane 6.

The inner flat areas 17 of the portholes 14 of the second inlet and outlet ports 21, 22 of the first heat exchanger plates A' that adjoin a respective third plate interspace 3, is located at the top plane 6.

The inner flat areas 17 of the portholes 14 of the second inlet and outlet ports 21, 22 of the second heat exchanger plates B' that adjoin a respective third plate interspace 3, is located at the bottom plane 7.

In a corresponding manner, the inner flat areas 17 of the portholes 14 of the third inlet and outlet ports 31, 32 of the first heat exchanger plates A, that adjoin a respective second plate interspace 2, is located at the top plane 6.

The inner flat areas 17 of the portholes 14 of the third inlet and outlet ports 31, 32 of the second heat exchanger plates B, that adjoin a respective second plate interspace 2, is located at the bottom plane 7.

The first heat exchanger plates A, A', A" comprise a first end plate A" that adjoins an outermost one of the first plate interspaces 1 and the frame plate 8. The second heat exchanger plates B, B', B" comprise a second end plate B" that adjoins the other outermost one of the first plate interspaces 1 and the pressure plate 9. The first end plate A" is modified in relation to the first heat exchanger plates A, A' in that the inner flat area 17 of the portholes 14 of the second inlet and outlet ports is located at the top plane 7. The second end plate B" is modified in relation to the second heat exchanger plates B, B' in that the inner flat area 17 of the portholes 14 of the third inlet port 31 and the second inlet port 32 is located at the bottom plane 7.

According to an alternative embodiment, the outer flat area 15 of the portholes 14 of the first inlet and outlet ports 11, 12 may be surrounded by an inner flat area 17 in the same way as the portholes 14 of the second and third inlet and outlet ports 21, 22, 31, 32. The inner flat area 17 of the portholes 14 of the first inlet and outlet ports 11, 12 is then located between the top plane 6 and the bottom plane 7 to permit communication for the first medium between the first inlet and outlet ports 11, 12 and the first plate interspaces 1.

The present invention is not limited to the embodiments disclosed above, but may be varied and modified within the scope of the following claims.

The invention claimed is:

1. A plate heat exchanger comprising:

a plate package of heat exchanger plates being stacked onto each other to form:

first plate interspaces for a primary medium;

second plate interspaces for a first secondary medium; and third plate interspaces for a second secondary medium, wherein each of the heat exchanger plates extends in parallel with an extension plane and comprises a heat exchanger area with a corrugation that extends between a top plane and a bottom plane, which are parallel to each other and to the extension plane, wherein the plate package comprises six ports extending through the heat exchanger plates and comprising:

a first inlet port and a first outlet port for the supply and discharge of the primary medium to and from the first plate interspaces;

a second inlet port and a second outlet port for the supply and discharge of the first secondary medium to and from the second plate interspaces; and a third inlet port and a third outlet port for the supply and discharge of the second secondary medium to and from the third plate interspaces, wherein each of the ports is formed by a porthole through each of the heat exchanger plates, wherein each porthole is surrounded by an outer flat area, which forms a porthole edge, wherein the outer flat area of the second inlet and outlet ports and the third inlet and outlet ports is surrounded by an inner flat area, wherein the outer flat area of the portholes of the ports of the heat exchanger plates is located at one of the top plane and the bottom plane, wherein the inner flat areas of the portholes of the second inlet and outlet ports of the heat exchanger plates, that enclose the second plate interspaces, are located at a distance from each other and from the top and bottom planes, and wherein the inner flat areas of the portholes of the second inlet and outlet ports of the heat exchanger plates, that enclose the third plate interspaces, adjoin each other and are located at one of the top plane and the bottom plane.

2. The plate heat exchanger according to claim 1, wherein the inner flat areas of the portholes of the third inlet and outlet ports of the heat exchanger plates, that enclose the third plate interspaces, are located at a distance from each other and from the top and bottom planes, and wherein the inner flat area of the portholes of the third inlet and outlet ports of the heat exchanger plates, that enclose the second plate interspaces, adjoin each other and are located at one of the top plane and the bottom plane.

3. The plate heat exchanger according to claim 1, wherein the outer flat area of the portholes of the first inlet and outlet ports of the heat exchanger plates adjoins the corrugation of the heat exchanger area.

4. The plate heat exchanger according to claim 1, wherein each of the portholes of the second inlet port has a diameter that is equal for all heat exchanger plates of the plate package.

5. The plate heat exchanger according to claim 1, wherein each of the portholes of the second outlet port has a diameter that is equal for all heat exchanger plates of the plate package.

6. The plate heat exchanger according to claim 1, wherein each of the portholes of the third inlet port has a diameter that is equal for all heat exchanger plates of the plate package.

7. The plate heat exchanger according to claim 1, wherein each of the portholes of the third outlet ports has a diameter that is equal for all heat exchanger plates of the plate package.

8. The plate heat exchanger according to claim 1, wherein the heat exchanger plates comprise first heat exchanger plates and second heat exchanger plates provided in an alternating order in the plate package.

9. The plate heat exchanger according to claim 8, wherein each of the second plate interspaces is provided between one of the second heat exchanger plates and one of the first heat exchanger plates, and each of the third plate interspaces is provided between one of the second heat exchanger plates and one of the first heat exchanger plates.

10. The plate heat exchanger according to claim 8, wherein the inner flat areas of the portholes of the second inlet and outlet ports of the first heat exchanger plates, that adjoin the third plate interspaces, is located at the top plane.

11. The plate heat exchanger according to claim 8, wherein the inner flat areas of the portholes of the second inlet and outlet ports of the second heat exchanger plates, that adjoin the third plate interspaces, is located at the bottom plane.

12. The plate heat exchanger according to claim 8, wherein the inner flat areas of the portholes of the third inlet and outlet ports of the first heat exchanger plates, that adjoin the second plate interspaces, is located at the top plane.

13. The plate heat exchanger according to claim 8, wherein the inner flat areas of the portholes of the third inlet and outlet ports of the second heat exchanger plates, that adjoin the second plate interspaces, is located at the bottom plane.

14. The plate heat exchanger according to claim 8, wherein each of the first plate interspaces is provided between one of the first heat exchanger plates and one of the second heat exchanger plates.

15. The plate heat exchanger according to claim 8, wherein the first heat exchanger plates comprise a first end plate that adjoins an outermost one of the first plate interspaces, and the second heat exchanger plates comprise a second end plate that adjoins another outermost one of the first plate interspaces.

16. The plate heat exchanger according to claim 2, wherein the outer flat area of the portholes of the first inlet and outlet ports of the heat exchanger plates adjoins the corrugation of the heat exchanger area.

17. The plate heat exchanger according to claim 2, wherein each of the portholes of the second inlet port has a diameter that is equal for all heat exchanger plates of the plate package.

18. The plate heat exchanger according to claim 3, wherein each of the portholes of the second inlet port has a diameter that is equal for all heat exchanger plates of the plate package.

19. The plate heat exchanger according to claim 2, wherein each of the portholes of the second outlet port has a diameter that is equal for all heat exchanger plates of the plate package.

20. The plate heat exchanger according to claim 3, wherein each of the portholes of the second outlet port has a diameter that is equal for all heat exchanger plates of the plate package.

* * * * *